US008209983B2

(12) United States Patent
Palazzolo et al.

(10) Patent No.: US 8,209,983 B2
(45) **Date of Patent: *Jul. 3, 2012**

(54) TURBOCHARGER SYSTEM FOR INTERNAL COMBUSTION ENGINE WITH REDUCED FOOTPRINT TURBOCHARGER MOUNTING PEDESTAL

(75) Inventors: Christopher Kelly Palazzolo, Ann Arbor, MI (US); Patrick Sexton, Ypsilanti, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 963 days.

This patent is subject to a terminal disclaimer.

(21) Appl. No.: 12/145,774

(22) Filed: Jun. 25, 2008

(65) Prior Publication Data

US 2009/0320469 A1 Dec. 31, 2009

(51) Int. Cl.
*F02G 3/00* (2006.01)
*F02B 33/44* (2006.01)

(52) U.S. Cl. ..... 60/624; 60/605.3

(58) Field of Classification Search ..... 60/605.3; 184/6.16; 123/195 A; 248/637, 678; 415/213.1; 417/406

See application file for complete search history.

(56) References Cited

U.S. PATENT DOCUMENTS

| | | | | |
|---|---|---|---|---|
| 4,483,147 | A * | 11/1984 | Evans et al. | 60/611 |
| 4,643,137 | A | 2/1987 | Choushi | |
| 4,716,735 | A * | 1/1988 | Ruf et al. | 60/605.3 |
| 5,079,921 | A | 1/1992 | McCandless | |
| 5,139,349 | A | 8/1992 | Nakano | |
| 5,544,486 | A * | 8/1996 | Lu | 60/599 |
| 6,125,799 | A | 10/2000 | Van Son | |
| 6,484,683 | B2 | 11/2002 | Zielke | |
| 2001/0048062 | A1 | 12/2001 | Murao | |
| 2005/0257521 | A1 | 11/2005 | Anello | |
| 2007/0175456 | A1 | 8/2007 | Tally | |
| 2007/0234997 | A1 | 10/2007 | Prenger | |

FOREIGN PATENT DOCUMENTS

| | | | |
|---|---|---|---|
| DE | 10218354 | A1 | 11/2003 |
| GB | 2424450 | A | 9/2006 |

* cited by examiner

*Primary Examiner* — Thomas Denion
*Assistant Examiner* — Cameron Setayesh
(74) *Attorney, Agent, or Firm* — Julia Voutyras; Alleman Hall McCoy Russell & Tuttle LLP

(57) ABSTRACT

A turbocharger system for an internal combustion engine includes a turbocharger with a utility pedestal extending between the turbocharger and a mounting point associated with the cylinder block. The utility pedestal includes a mounting pad for attaching the combined turbocharger and pedestal assembly to an engine, as well as oil and coolant supply passages for supplying the turbocharger with coolant and lubricating oil under pressure. The utility pedestal's fastening system is configured so as to cover a minimum amount of space of the engine surface to which the pedestal is mounted, so as to reduce the footprint of the turbocharger system.

16 Claims, 6 Drawing Sheets

TURBOCHARGER SYSTEM FOR INTERNAL COMBUSTION ENGINE WITH REDUCED FOOTPRINT TURBOCHARGER MOUNTING PEDESTAL

CROSS REFERENCE TO RELATED APPLICATIONS

None.

BACKGROUND OF THE INVENTION

1. Field of the Invention

The present invention relates to a turbocharger system including not only a turbocharger, but also a compact mounting pedestal arranged with utilities needed to operate and position the turbocharger within the space between opposing cylinder banks of an engine.

2. Related Art

Turbocharging has been used for a number of years with internal combustion engines. Although early turbochargers were often cooled primarily by air, as well as by the flow of oil through the turbocharger's bearings, later model turbochargers, especially larger turbochargers and those installed in heavy duty engines, generally utilize coolant circulating from the engine's cooling system through the turbo, and then back to the engine's main cooling system. Of course, turbochargers also require an oil supply and drain utilities to lubricate the bearings associated with the turbocharger. Needless to say, the provision of a source of coolant and a source of oil, with both being under pressure, as well as draining the oil and coolant from the turbocharger and returning these fluids separately to the engine, has necessitated a good deal of external plumbing. Unfortunately, external fluid connections and associated pipes and hoses cause problems because hoses and fittings are known to leak and are subject to damage which may be accelerated by the high temperatures prevailing within engine compartments. Moreover, aside from durability issues, the need for external plumbing for turbochargers increases the space required by the turbocharger in an already crowded underhood environment.

Turbochargers mounted on engines typically consume a good deal of space for another reason. Because known mounting arrangements are not susceptible to locating the turbocharger close to the engine block, turbochargers must be spaced away from the engine to permit the insertion and removal of the turbochargers' fasteners. Moreover, known turbocharger mounting systems increase radiated noise because of a lack of rigidity and because of the dimensional problems associated with their usage. U.S. Pat. No. 6,125,799 discloses a turbocharger mounting system which is bulky and therefore packageable only at the ends of an engine, and which makes liberal use of external fluid lines prone to damage and leaking.

It would be desirable to provide a turbocharger, including a mounting system which reduces the amount of space occupied by the turbocharger, while reducing the turbocharger's noise signature.

SUMMARY OF THE INVENTION

According to an aspect of the present invention, a turbocharger system for an internal combustion engine having a cylinder block includes a turbocharger and a utility pedestal extending between the turbocharger and a hard point associated with the cylinder block. The utility pedestal includes a mounting pad for the pedestal and an oil supply passage for conveying lubricating oil under pressure from the cylinder block to the turbocharger. A return oil passage conveys lubricating oil from the turbocharger to a lubrication system incorporated within the engine. A coolant supply passage conveys coolant under pressure to the turbocharger, and a coolant return passage, configured at least in part within the utility pedestal, conveys coolant from the turbocharger to a cooling system incorporated within the engine. According to another aspect of the present invention, the coolant return passage may include a passage configured, at least in part, within the engine's cylinder block, as well as within the utility pedestal.

According to another aspect of the present invention a coolant return passage from the turbocharger may be configured so as to convey the coolant to a mixing chamber within which the coolant from the turbocharger is mixed with coolant flowing from at least one cylinder head.

According to another aspect of the present invention, a return oil passage from the turbocharger conveys waste oil from the turbocharger to a crankcase sump without allowing the waste oil to contact moving parts within the engine.

According to another aspect of the present invention, a hard point associated with the cylinder block for mounting the turbocharger includes a generally planar mounting pad configured on a portion of the cylinder block, with the mounting pad of the utility pedestal having a lower mating surface matched to the generally planar mounting pad. The cylinder block's mounting pad is configured with lubricating oil and coolant utilities.

According to another aspect of the present invention, a turbocharger's generally planar mounting pad may be configured upon a cylinder block within a valley defined by the cylinder banks of a V-block engine.

According to yet another aspect of the present invention, the turbocharger pedestal mounting pad of the utility pedestal comprises a number of mounting bosses having fastener bores extending therethrough at an acute angle with respect to a horizontal plane such that fasteners inserted within the bores pass inboard to threaded bores formed in a hard point associated with the cylinder block.

According to another aspect of the present invention, the return, or waste, oil passage extending from the turbocharger and through the utility pedestal is designed to prevent foamed or frothed oil flowing from the turbocharger from impairing engine lubrication. This is accomplished by preventing the waste oil from contacting moving parts within the engine as the oil flows back to the crankcase sump.

It is an advantage of the present turbocharger system that a turbocharger may be mounted to an engine upon a surface which is smaller than the surfaces required with known turbo mounting systems.

It is an advantage of the present turbocharger system that the turbocharger and pedestal may be assembled at one geographic location and installed upon an engine as a single unit at a second geographic location without the need for making external utility connections for lubricating oil and water feeds and drains.

It is another advantage of a turbocharging system according to the present invention that a turbocharger system, including the turbocharger and the utility pedestal, with its oil and coolant utilities, is compact and ideally suited for mounting in the valley of a V-block internal combustion engine.

It is yet another advantage of a turbocharging system according to the present invention that the noise signature of the turbocharger will be reduced because of the stiffness inherent with the close-mounted utility pedestal featured in the present invention.

It is yet another advantage of the present invention that the fasteners used to mount the pedestal to the engine may be accessed without removing portions of the turbocharger.

Other advantages, as well as features of the present invention, will become apparent to the reader of this specification.

DETAILED DESCRIPTION OF THE PREFERRED EMBODIMENTS

Figure 1:
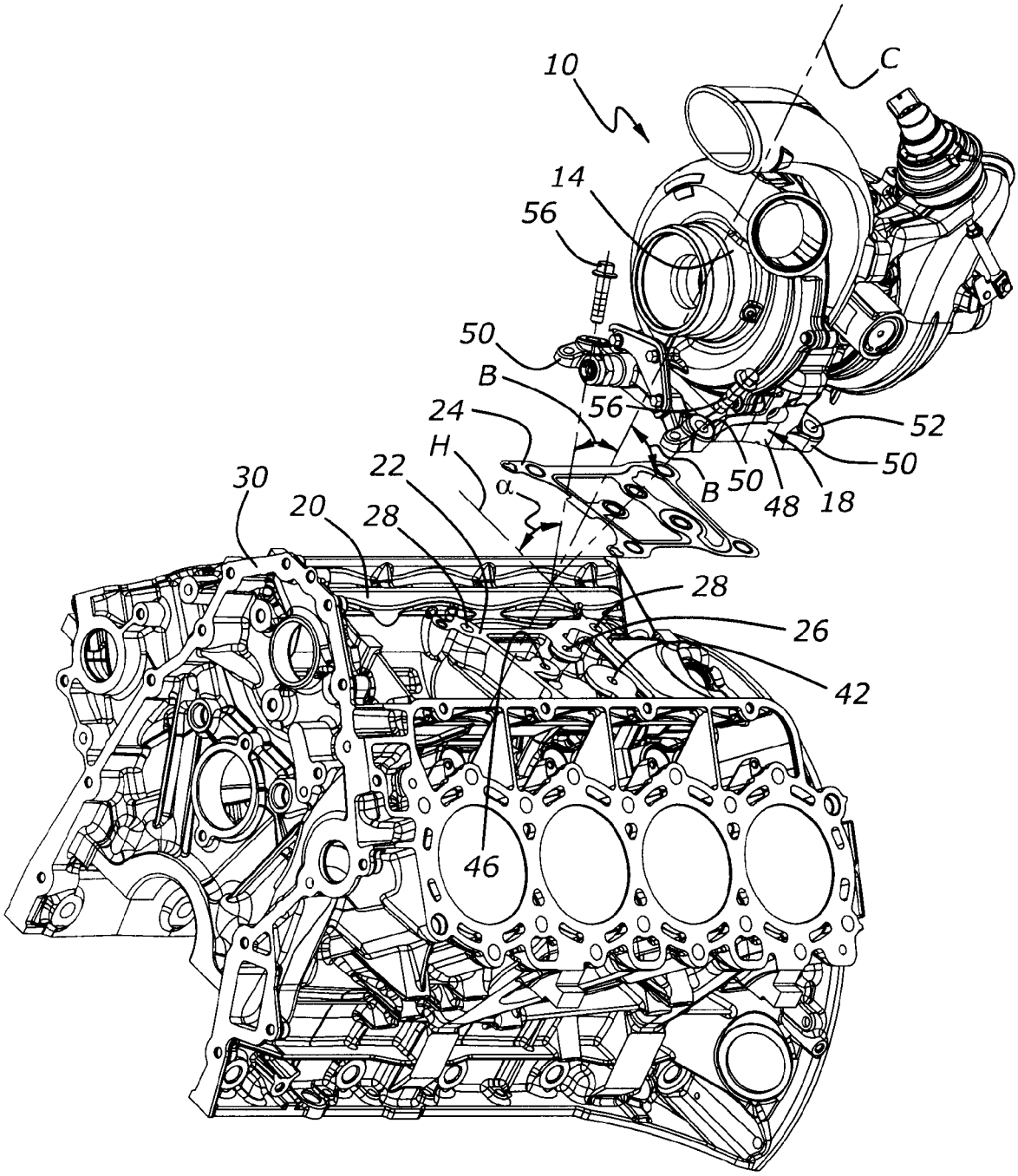
FIG. 1 is an exploded perspective view of an engine having a turbocharger system according to the present invention.

As shown in FIG. 1, turbocharger system 10 includes a turbocharger, 14, and a utility pedestal, 18. Turbocharger 14 is preferably mounted to utility pedestal 18 before turbocharger 14 is mounted upon an engine. FIG. 1 also shows an engine cylinder block, 30, having a valley, 20, into which turbocharger system 10 is placed upon a hard point, which is illustrated as generally planar mounting pad 22, which is one piece with cylinder block 30. Utility pedestal 18 provides rigid structural support for turbocharger 14; this helps to reduce unwanted engine noise emissions, as well as reducing unwanted vibration associated with the turbocharger.

Figure 6:
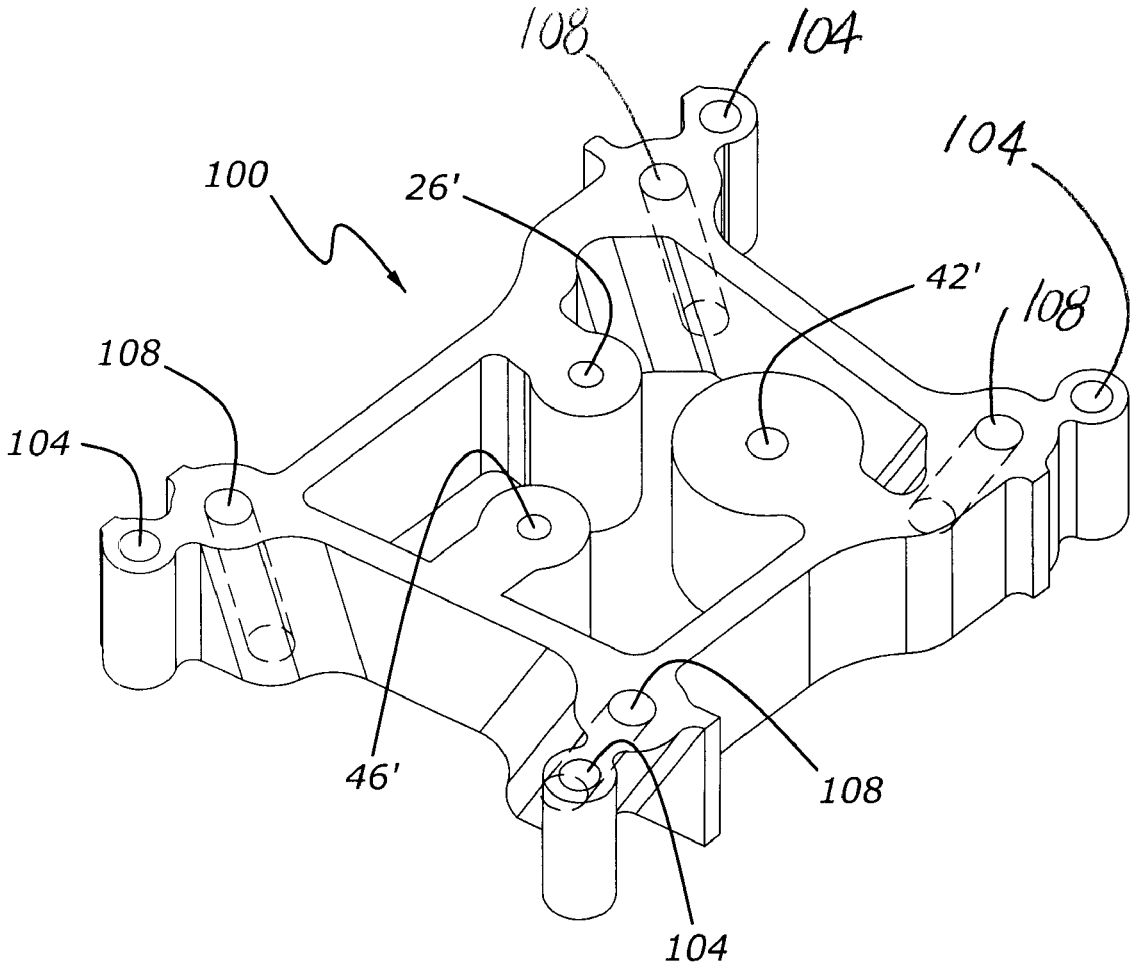
FIG. 6 is a perspective view of a turbocharger mounting hard point configured as a plate suitable for bolting or welding to an engine cylinder block or other engine structure.

Those skilled in the art will appreciate in view of this disclosure that the term "hard point", as used herein means either a structurally rigid mounting location such as block pad 22 machined into the parent metal of a cylinder block, or a separate pad or bracket, such as that illustrated at 100 in FIG. 6. Mounting pad 100 is intended to be attached to an engine by bolting, or welding, or by any other suitable process.

Utility pedestal 18 has a mounting pad, 48, at its lower extremity. Mounting pad 48 includes mounting bosses 50, which have fastener bores 52. Fastener bores 52 extend through mounting bosses 50 and make an acute angle, $\alpha$, with a horizontal plane, H (FIG. 1). Stated another way, fastener bores 52 make an acute angle, $\beta$, with respect to a central axis, C, (FIG. 1), extending through utility pedestal 18, such that fasteners 56 inserted within fastener bores 52 pass inboard toward central axis C, with the result that fasteners 56, when fully driven, extend laterally outboard of central axis C to a lesser extent than the lateral space occupied by turbocharger 14. In effect, fastener bores 52 define fastener access zones extending from bosses 50 at an acute angle to axis C.

Figure 2:
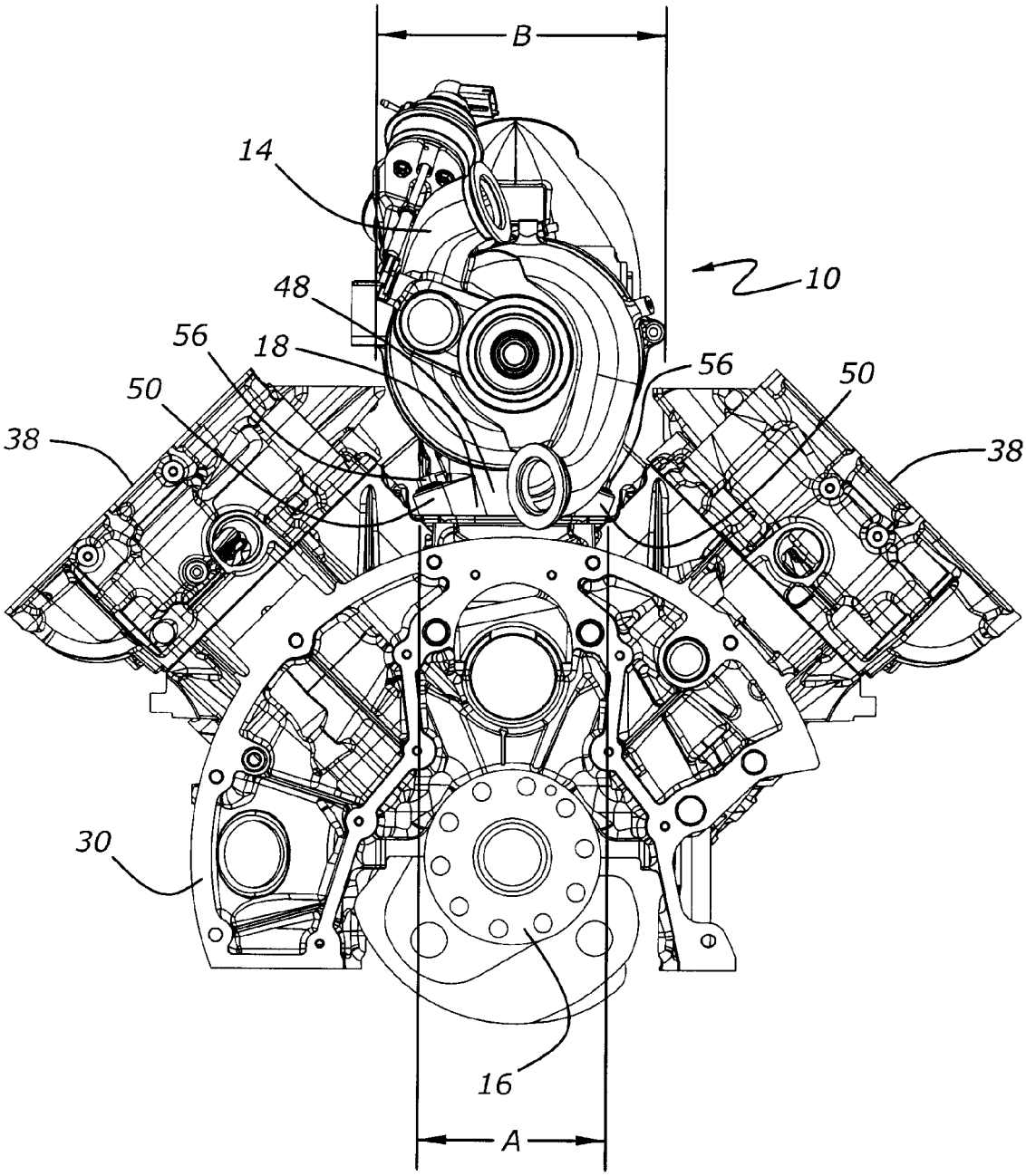
FIG. 2 is an end view, partially cut away, of a portion of an engine having a turbocharger system according to the present invention.

As noted above, fastener bores 52 allow the passage of a number of threaded fasteners, 56, which pass through fastener bores 52 and into threaded bores, 28, formed in generally planar mounting pad 22 of cylinder block 30. Two of threaded bores 28 are shown in FIG. 1. FIG. 1 further shows that mounting bosses 50 are angled so that threaded fasteners or bolts 56 extend inboard into bolt holes 28 formed in mounting pad 22 of cylinder block 30. This geometry is also shown in FIG. 2. In the event that a separate mounting pad or plate is employed, such as that illustrated at 100 in FIG. 6, a number of fastener bores, 108, will be provided in the same manner as bores 52. Pad 100 also contains fluid passages 26', 42', and 46', which perform the functions ascribed to passages 26, 42, and 46, respectively. Pad 100 may be fastened to an engine by means of threaded fasteners extending through bores 104, or by welding or other known methods.

As seen in FIG. 2, the width, A, of utility pedestal mounting pad 48 is less than the overall width, B, of turbocharger 14. This results from the fact that the plan view lateral extension of fasteners 56 is less than the plan view lateral extension of turbocharger 14. This reduced footprint is a valuable benefit stemming from the angular orientation of fastener bores 52, which fortuitously permit turbocharger 14 and utility pedestal 18 to be disassembled as one unit from the engine without removing portions of the turbocharger assembly. The angles of fastener bores 52 also allow turbocharger 14 to be mounted closer to cylinder block 30, in a vertical direction closer to crankshaft 16. FIG. 2 shows turbocharger 14 nestled in valley 20 between cylinder heads 38 and cylinder block 30. The reduced height of this mounting arrangement, as compared with known turbocharger hardware, has the further benefit of reducing vibration and attendant noise.

Figure 3:
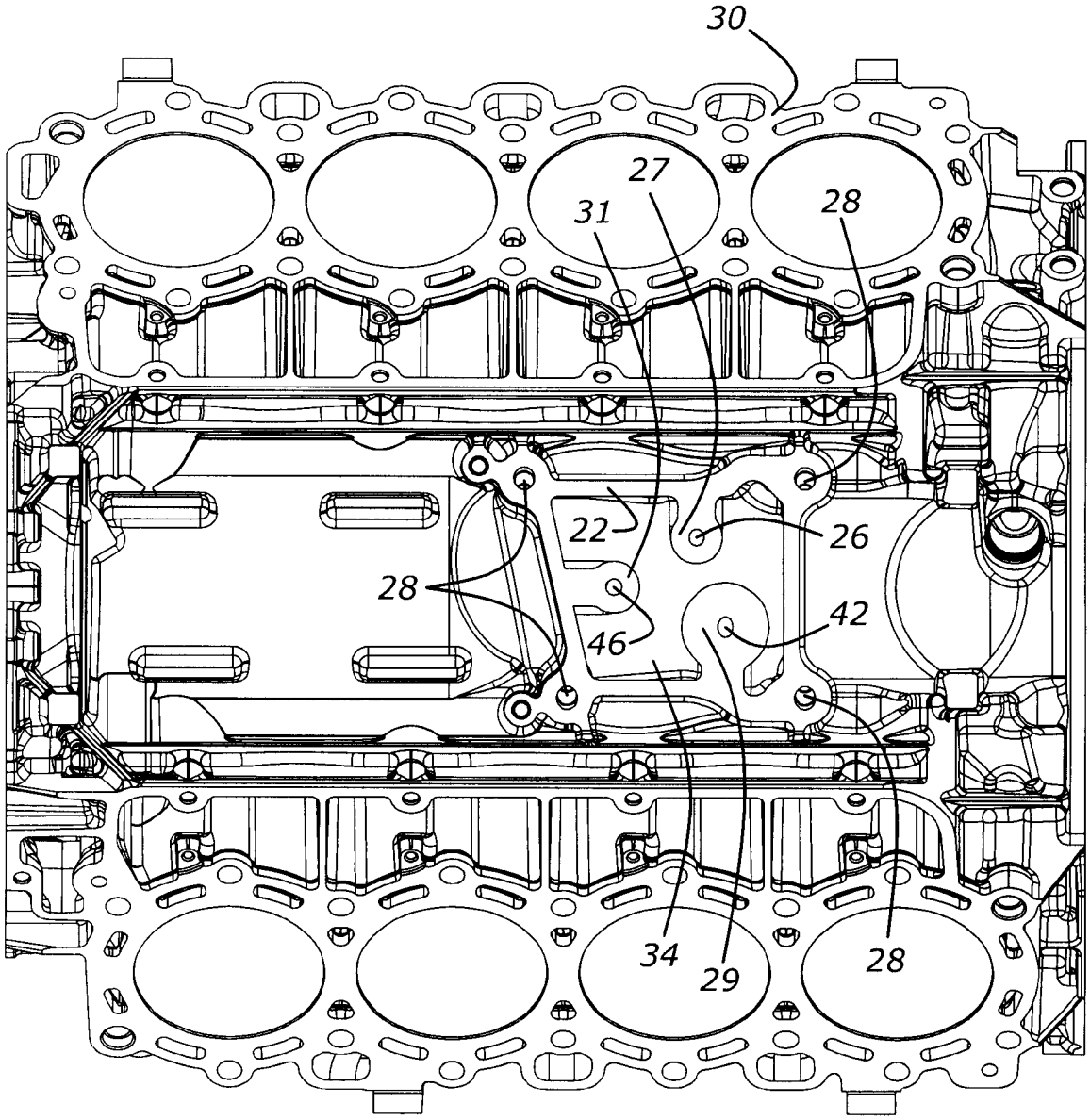
FIG. 3 is a plan view of an engine block showing a turbocharger pedestal mounting pad and utility passages for lubricating oil and coolant according to an aspect of the present invention.

FIG. 3 shows generally planar mounting pad 22 as being located in the mid-portion of the valley of cylinder block 30. Several of threaded mounting bolt holes 28 are shown. FIG. 3 further illustrates several utilities for turbocharger 14. The first such utility, oil supply passage 26, is shown as terminating in a port formed within the planar surface of mounting pad 22. Coolant supply passage 42 also communicates with this surface, as does coolant return 46. In other words, portions of oil supply passage 26, coolant supply passage 42, and coolant return passage 46 are all co-planar with the uppermost surface of mounting pad 22. As a result, all of these utilities may be sealed to utility pedestal 18 with a single gasket 24, which is shown in FIG. 1. Gasket 24 is illustrated as a unitary carrier incorporating a number of integral o-rings for sealing passages 26, 42, and 46.

Figure 4:
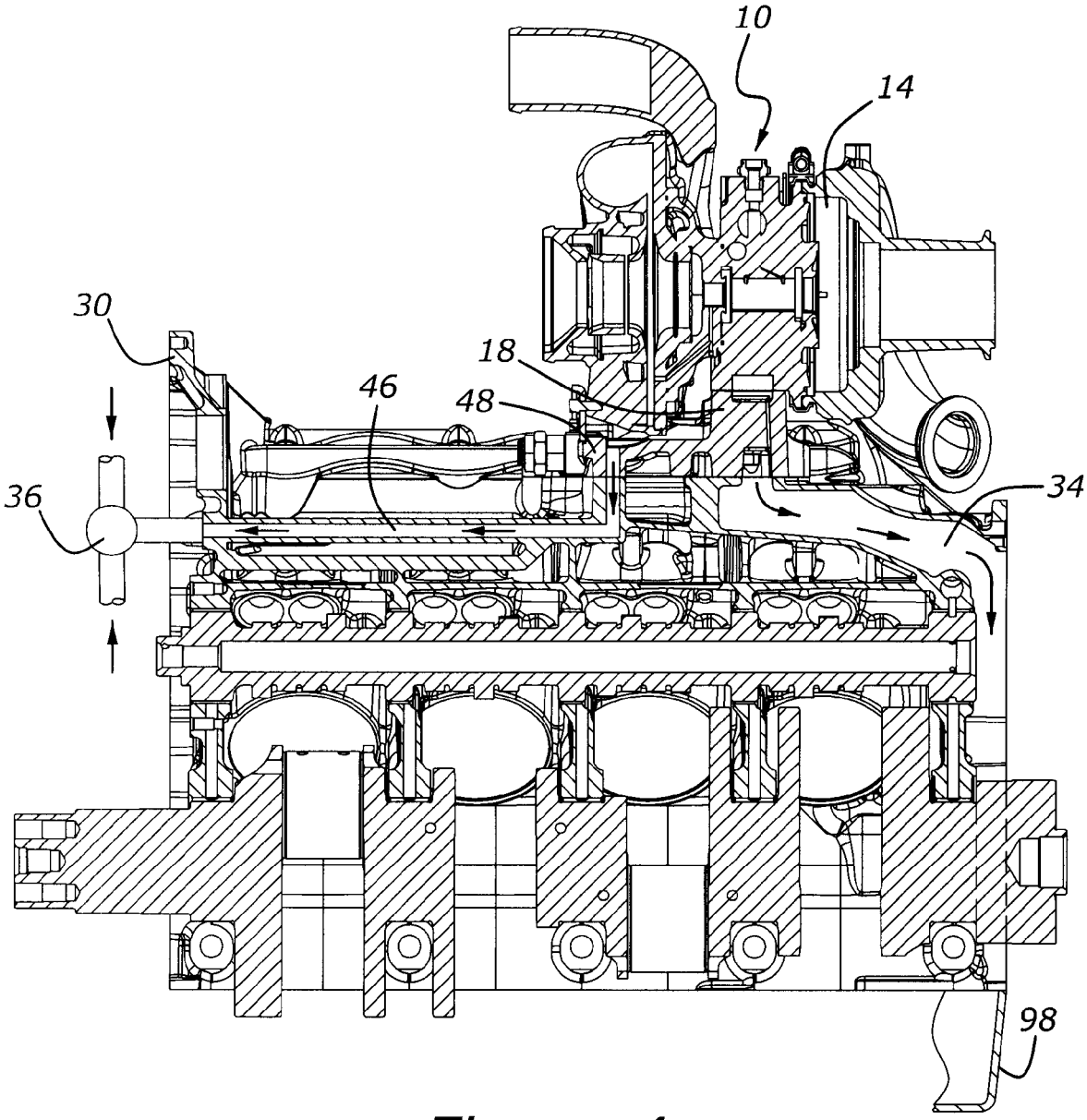
FIG. 4 is a side elevation, partially cut away, of an engine having a turbocharger system according to the present invention and showing the routing for several of the utility passages for oil and water according to the present invention.

Only the uppermost part of return oil isolation passage 34 within cylinder block 30 is shown in FIG. 3; for more definition, one must look to FIG. 4, wherein return oil passage 34 is shown as leading to one end of cylinder block 30 and down into a crankcase sump, 88, through a region in which there are no rotating or moving parts. As noted above, the drainback of waste oil from turbocharger 14 to the crankcase sump through areas of the engine devoid of moving parts prevents galling or overheating of such moving parts by preventing contact between temporarily aerated oil and parts needing lubrication.

Figure 5:
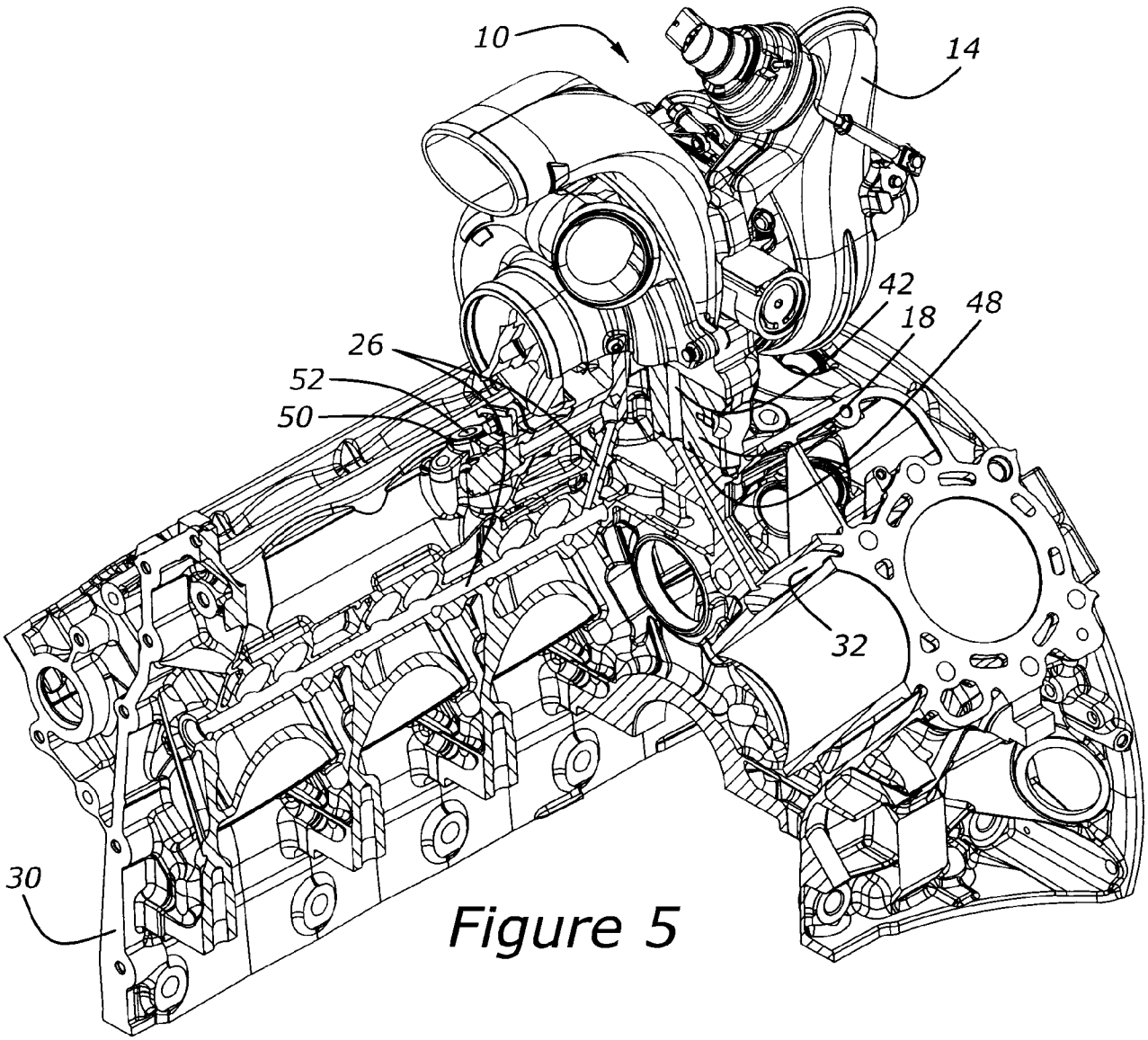
FIG. 5 is a side perspective view, partially cut away, of an engine having a turbocharger system according to the present invention.

FIGS. 4 and 5 show oil supply passage 26 extending up into utility pedestal 18 from within cylinder block 30. Further, FIG. 5 shows coolant supply passage 42, which extends into utility pedestal 18 from an engine water jacket, 32. Water leaving turbocharger 14 flows through coolant return passage 46 down through utility pedestal 18 and out to the front of engine block 30, (FIG. 4), wherein the flow is joined with coolant flow from one or more cylinder heads at a combination point 36. Coolant return passage 46 may advantageously be configured as a cored passage within cylinder block 30. Those skilled in the art will appreciate, in view of this disclosure that combination point 36 could be configured as a water outlet or coolant surge tank or other device for combining coolant flows from more than one source, such as one or more of the engine's cylinder heads. This combination of flows offers the advantage of mitigating coolant temperature excursions which could otherwise result from the very warm coolant leaving turbocharger 14.

The foregoing invention has been described in accordance with the relevant legal standards, thus the description is exemplary rather than limiting in nature. Variations and modifications to the disclosed embodiment may become apparent to those skilled in the art and fall within the scope of the invention. Accordingly the scope of legal protection afforded this invention can only be determined by studying the following claims.

What is claimed is:

1. A turbocharger system for an engine having a cylinder block, comprising:

a turbocharger; and a utility pedestal extending between the turbocharger and an engine mounting point, comprising:

a mounting pad for the pedestal being a sole mounting connection for the turbocharger, said mounting pad having a plurality of mounting bosses with fastener bores, wherein axes of the fastener bores are at an acute angle with respect to a central axis through said pedestal.

2. A turbocharger system according to claim 1, further comprising: an oil supply passage extending through said mounting pad.

3. A turbocharger system according to claim 1, further comprising: a return oil passage extending through said mounting pad.

4. A turbocharger system according to claim 3, wherein said return oil passage conveys waste oil from the turbocharger through said mounting pad and into a crankcase sump.

5. A turbocharger system according to claim 1, further comprising: a coolant supply passage extending through said mounting pad.

6. A turbocharger system according to claim 2, wherein said fasteners, when fully driven into said fastener bores, extend laterally outboard of said central axis to a lesser extent than a lateral space occupied by said turbocharger.

7. An internal combustion engine, comprising:

a V-block configured cylinder block;

a plurality of cylinder heads attached to said cylinder block, with said cylinder heads and said cylinder block defining a valley between the cylinder heads; and a turbocharger mounted upon a reduced footprint utility pedestal extending between the turbocharger and a hard point associated with the cylinder block, with the pedestal comprising:

a mounting pad for the pedestal, with said mounting pad having a plurality of mounting bosses with fastener bores extending therethrough at an acute angle with respect to a central axis through said pedestal, such that fasteners inserted within the fastener bores pass inboard and into threaded bores formed within the hard point, and with said fasteners extending laterally outboard of said engine to a lesser extent than a lateral space occupied by said turbocharger, and wherein the mounting pad provides a sole mounting connection for the turbocharger;

an internal oil supply passage for conveying lubricating oil under pressure from the cylinder block to the turbocharger; and an internal return oil passage for conveying lubricating oil from the turbocharger to a lubrication system incorporated within the engine.

8. An internal combustion engine according to claim 7, further comprising an internal coolant return passage contained at least in part within the pedestal.

9. An internal combustion engine according to claim 7, further comprising an internal coolant supply passage contained at least in part within the pedestal.

10. A turbocharger system for an internal combustion engine having a cylinder block, with said turbocharger system comprising:

a turbocharger; and a reduced footprint utility pedestal extending between the turbocharger and a hard point associated with the cylinder block, with the pedestal comprising:

a mounting pad for the pedestal, with said mounting pad having a plurality of mounting bosses with fastener bores extending therethrough at an acute angle with respect to a central axis through said pedestal, and with said mounting bosses and said fastener bores defining a fastener access zone extending from said mounting bosses at an acute angle with respect to said central axis, with said fastener access zone being oriented such that fasteners may be removed from said pedestal without dismounting said turbocharger from said pedestal, and wherein the mounting pad provides a sole mounting connection for the turbocharger;

an oil supply passage for conveying lubricating oil under pressure from the cylinder block to the turbocharger;

a return oil passage for conveying lubricating oil from the turbocharger to a lubrication system incorporated within the engine; and a coolant supply passage for conveying coolant under pressure to the turbocharger.

11. A turbocharger system according to claim 10, wherein a plan view lateral extension of said fasteners is less than a plan view lateral extension of said turbocharger.

12. A turbocharger system according to claim 1, further comprising: fasteners extending through the fastener bores.

13. A turbocharger system according to claim 1, further comprising: at least one fluid passage for conveying fluid through the pedestal.

14. A turbocharger system according to claim 1, further comprising: at least one fluid passage for conveying fluid between the cylinder block and the turbocharger, the fluid passage passing through the pedestal.

15. A turbocharger system according to claim 1, wherein a width of the pedestal mounting pad is less than an overall width of the turbocharger.

16. A turbocharger system according to claim 1 wherein the cylinder block includes a mounting pad into which threaded bores are provided, the threaded bores are adapted to align with the fastener bores of the mounting pad of the pedestal, the turbocharger system further comprising:

threaded fasteners extending through the fastener bores and engaging with threads of the threaded bores.

* * * * *